US006306944B1

(12) United States Patent
Seki

(10) Patent No.: US 6,306,944 B1
(45) Date of Patent: Oct. 23, 2001

(54) COMPOSITION FOR TREATING PAPER AND PAPER TREATED THEREWITH

(75) Inventor: Ryuji Seki, Kanagawa (JP)

(73) Assignee: Asahi Glass Company Ltd., Tokyo (JP)

( * ) Notice: Subject to any disclaimer, the term of this patent is extended or adjusted under 35 U.S.C. 154(b) by 0 days.

(21) Appl. No.: 09/447,568

(22) Filed: Nov. 23, 1999

(30) Foreign Application Priority Data

Nov. 24, 1998 (JP) ..... 10-333122
Feb. 26, 1999 (JP) ..... 11-051279

(51) Int. Cl.[7] ..... C08K 5/06
(52) U.S. Cl. ..... 524/366; 524/376; 524/544
(58) Field of Search ..... 524/186, 366, 524/376, 544

(56) References Cited

U.S. PATENT DOCUMENTS 3,532,659 10/1970 Hager et al. .

FOREIGN PATENT DOCUMENTS 0 572 269 12/1993 (EP) .
0 713 939 5/1996 (EP) .

OTHER PUBLICATIONS

Derwent Abstracts, AN 1980–48705C, JP 55 069677, May 26, 1980.

*Primary Examiner*—Edward J. Cain
(74) *Attorney, Agent, or Firm*—Oblon, Spivak, Mcclelland, Maier & Neustadt, P.C.

(57) ABSTRACT

A composition for treating paper comprising a polymer (A), a surfactant (B) and a medium (C), wherein said polymer (A) comprises polymer units of (meth)acrylate having a polyfluoroalkyl group, polymer units of a vinylidene halide and/or polymer units of a long chain alkyl(meth)acrylate, and polymer units of the following formula 1:

$$-[CH_2-C(R)[CO-Q-(CH_2)_nCHR^4-CH_2N^+(R^1)(R^2)(R^3).X^-]]-, \quad \text{Formula 1}$$

wherein R is a hydrogen atom or a methyl group; Q is —O— or —$NR^5$—, wherein $R^5$ is a hydrogen atom or an alkyl group; each of $R^1$, $R^2$ and $R^3$ which are independent of one another is a hydrogen atom or an alkyl group; $R^1$ and $R^2$ may together form a bivalent organic group; $R^4$ is a hydrogen atom or a hydroxyl group; n is a number from 1 to 4 and $X^-$ is a counter ion.

14 Claims, No Drawings

COMPOSITION FOR TREATING PAPER AND PAPER TREATED THEREWITH

The present invention relates to a composition for treating paper and a paper treated with this composition.

In recent years, material of containers or packages for foods, confectionery, etc. has been changed from plastics to papers with an increasing interest in protection for the environment. Water- and oil-repellant treatments of papers are conducted to avoid penetration of oil or water contained in foods, confectionery, etc. to papers.

Heretofore, as a water and oil repellent for papers, various agents have been proposed as follows: (1) a treating agent comprising a phosphate containing a polyfluoroalkyl group (hereinafter referred as a $R^f$) (JP-A-64-6196, JP-A-3-123786), (2) a treating agent comprising a copolymer composed of polymer units of an acrylate having a $R^f$ group, polymer units of an alkyl(meth)acrylate and polymer units of a methacrylate having a polyethylene oxide group (JP-A-8-59751), (3) a treating agent comprising a copolymer of an acrylate having a $R^f$ group and vinylidene chloride (JP-A-55-69677, JP-A-51-133511, JP-B-53-22547). Further, as a water and oil repellent for fibers, (4) a copolymer comprising polymer units of an acrylate having a $R^f$ group and polymer units of octadecyl(meth)acrylate has been known.

However, a treating agent (1) comprising a phosphate containing a polyfluoroalkyl group has a problem that it can not impart adequate oil repellency to papers since the phosphate is a water soluble compound. Further, its oil repellency substantially decreases when it is used with a sizing agent together.

Meanwhile, as a general oil resistance treatment for papers, the post-application method has been known wherein papers are impregnated or coated with a treating agent. In this method, a size press and various coating machines may be used, and drying is conducted in a short time of from a few seconds to several tens seconds at from 80 to 100° C. When the post-application method is used, it is necessary to select a treating agent which can impart high water resistance and oil resistance under drying at a low temperature and in a short time.

When the treating agent (2) is used in the post-application method, however, a problem has been observed that adequate property is not shown. When the treating agent (3) diluted with water is applied to papers, dipping, nipping, circulation, etc. at high speed cause various drawbacks such as instability of the agent, occurrence of scum in the agent, stains of rolls, inadequate adhesion to papers. Thus, the agent (3) has such problem that it can not impart adequate property to papers. When the treating agent (4) is applied to papers and dried at low temperature and in a short time, adequate water repellency to the papers has not been attained.

It is an object of the present invention to solve the above-mentioned problems and to provide a composition for treating papers without such problems.

It is another object of the present invention to provide a paper having superior water repellency and oil resistance treated with such a composition for treating papers.

The inventors of the present invention have found that superior water repellency and oil resistance can be attained even under drying condition of at low temperature and in a short time, if papers are treated with a composition comprising, as an essential component, a copolymer comprising particular polymer units.

Further, it has also been found that said composition has such high mechanical stability that the scum in the liquid of the agents and stains of the rolls scarcely occur.

The present invention provides a composition for treating papers comprising, as essential components, a polymer (A), a surfactant (B) and a medium (C), wherein said polymer (A) comprises polymer units of (meth)acrylate having a $R^f$ group, polymer units of a vinylidene halide and/or polymer units of a long chain alkyl(meth)acylate, and polymer units of the following formula 1:

$$-[CH_2-C(R)[CO-Q-(CH_2)_nCHR^4-CH_2N^+(R^1)(R^2)(R^3).X^-]]-, \quad \text{Formula 1}$$

wherein R is a hydrogen atom or a methyl group; Q is —O— or —$NR^5$—, wherein $R^5$ is a hydrogen atom or an alkyl group; each of $R^1$, $R^2$ and $R^3$ which are independent of one another is a hydrogen atom or an alkyl group; $R^1$ and $R^2$ may together form a bivalent organic group; $R^4$ is a hydrogen atom or a hydroxyl group; n is a number from 1 to 4 and $X^-$ is a counter ion.

Now, the present invention will be described in detail with reference to the preferred embodiments.

In the present invention, an acrylate and a methacrylate are referred collectively as a (meth)acrylate. The same applies to the description of an (meth)acrylamide, etc.

The $R^f$ group is a alkyl group having at least two hydrogen atoms substituted with fluorine atoms. The $R^f$ group may have a straight chain structure or a branched chain structure. The carbon number of the $R^f$ group is preferably from 2 to 20, particularly preferably from 4 to 18.

The number of the fluorine atoms in the $R^f$ group is at least 60%, more preferably at least 80%, particularly preferably 100% in substantial, when the number is represented by the formula of [(number of fluorine atoms in the $R^f$ group)/(number of hydrogen atoms contained in an alkyl group having the same carbon number as in the $R^f$ group)]×100 (%). Further, an alkyl group having all hydrogen atoms substituted with fluorine atoms will be described as a perfluoroalkyl group.

The $R^f$ group may contain a chlorine atom, etc. An etheric oxygen atom may be inserted between the carbon-carbon bond in the $R^f$ group. Thus, the $R^f$ group may be a group having a moiety of polyfluorooxyalkylene.

The following groups may be mentioned as specific examples of the $R^f$ group.

$C_4F_9$— [any one of structural isomers such as $F(CF_2)_4$—, $(CF_3)_2CFCF_2$—, $(CF_3)_3C$— and $CF_3CF_2CF(CF_3)$—], $C_5F_{11}$— [such as $F(CF_2)_5$—], $C_6F_{13}$— [such as $(CF_2)_6$—], $C_7F_{15}$— [such as $F(CF_2)_7$—], $C_8F_{17}$— [such as $F(CF_2)_8$—], $C_9F_{19}$— [such as $F(CF_2)_9$—], $C_{10}F_{21}$— [such as $F(CF_2)_{10}$—], $C_{12}F_{25}$— [such as $F(CF_2)_{12}$—], $C_{14}F_{29}$— [such as $F(CF_2)_{14}$—], $C_{16}F_{33}$— [such as $F(CF_2)_{16}$—], $Cl(CF_2)_s$— (wherein s is an integer of from 2 to 16), $H(CF_2)_t$— (wherein t is an integer of from 2 to 16), $(CF_3)_2CF(CF_2)e$- (wherein e is an integer of from 1 to 14), etc.

The following groups may be mentioned as specific examples of the case where the $R^f$ group is a group having an etheric oxygen atom inserted between the carbon-carbon bond.

$F(CF_2)_5OCF(CF_3)$—, $F[CF(CF_3)CF_2O]_rCF(CF_3)CF_2CF_2$—, $F[CF(CF_3)CF_2O]_zCF(CF_3)$—, $F[CF(CF_3)CF_2O]_uCF_2CF_2$—, $F(CF_2CF_2CF_2O)_vCF_2CF_2$—, $F(CF_2CF_2O)_wCF_2CF_2$— (wherein each of r and z is an integer of from 1 to 10, u is an integer of from 2 to 6, v is an integer of from 1 to 11, and w is an integer of from 1 to 11).

The $R^f$ group is preferably a perfluoroalkyl group. The perfluoroalkyl group has a straight chain structure and is preferably represented by $F(CF_2)_p$— (wherein p is an integer of from 4 to 16, preferably from 6 to 12).

The (meth)acrylate having a $R^f$ group in the present invention is a compound wherein a $R^f$ group exists in a ester residual group of (meth)acrylate. The (meth)acrylate having a $R^f$ group may be composed of one type, or two or more types. In the case of two or more types, a mixture of at least two types having different numbers of carbon atoms one another in the $R^f$ group is preferred.

The following compounds may be mentioned as the (meth)acrylate having a $R^f$ group. In the compounds, $R^6$ represents a hydrogen atom or a methyl group and $R^f$ represents a $R^f$ group mentioned above, preferably a perfluoroalkyl group.

$CH_2{=}CR^6COOCH_2CH_2R^f$, $CH_2{=}CR^6COOCH_2CH_2N(CH_2CH_2CH_3)COR^f$, $CH_2{=}CR^6COOCH(CH_3)CH_2R^f$, $CH_2{=}CR^6COOCH_2CH_2N(CH_3)SO_2R^f$, $CH_2{=}CR^6COOCH_2\ CH_2N\ (CH_3)COR^f$, $CH_2{=}CR^6COOCH_2CH_2N(CH_2CH_3)SO_2R^f$, $CH_2{=}CR^6COOCH_2CH_2N(CH_2CH_3)COR^f$, $CH_2{=}CR^6COOCH_2CH_2N(CH_2CH_2CH_3)SO_2R^f$, $CH_2{=}CR^6COOCH(CH_2Cl)CH_2OCH_2CH_2N(CH_3)SO_2R^f$,

The following compounds may be mentioned as specific examples of the (meth)acrylate having a $R^f$ group.

$F(CF_2)_5CH_2OCOCR^6{=}CH_2$, $F(CF_2)_6CH_2CH_2OCOCR^6{=}CH_2$, $H(CF_2)_6CH_2OCOCR^6{=}CH_2$, $H(CF_2)_8CH_2OCOCR^6{=}CH_2$, $H(CF_2)_{10}CH_2OCOCR^6{=}CH_2$, $H(CF_2)_8CH_2CH_2OCOCR^6{=}CH_2$, $F(CF_2)_8CH_2CH_2CH_2OCOCR^6{=}CH_2$, $F(CF_2)_{10}CH_2CH_2OCOCR^6{=}CH_2$, $F(CF_2)_{12}CH_2CH_2OCOCR^6{=}CH_2$, $(CF_3)_2CF(CF_2)_4CH_2CH_2OCOCR^6{=}CH_2$, $(CF_3)_2CF(CF_2)_6CH_2CH_2OCOCR^6{=}CH_2$, $(CF_3)_2CF(CF_2)_8CH_2CH_2OCOCR^6{=}CH_2$, $F(CF_2)_8SO_2N(C_3H_7)CH_2CH_2OCOCR^6{=}CH_2$, $F(CF_2)_8CON(C_3H_7)CH_2CH_2OCOCR^6{=}CH_2$, $F(CF_2)_8CH_2CH(CH_3)OCOCR^6{=}CH_2$, $F(CF_2)_8\ (CH_2)_4OCOCR^6{=}CH_2$, $F(CF_2)_8SO_2N(CH_3)CH_2CH_2\ OCOCR^6{=}CH_2$, $F(CF_2)_8CON(CH_3)CH_2CH_2OCOCR^6{=}CH_2$, $F(CF_2)_8SO_2N(C_2H_5)CH_2CH_2OCOCR^6{=}CH_2$, $F(CF_2)_8CON\ (C_2H_5)CH_2CH_2\ OCOCR^6{=}CH_2$, $F(CF_2)_8CONHCH_2CH_2OCOCR^6{=}CH_2$, $(CF_3)_2CF(CF_2)_5\ (CH_2)_3OCOCR^6{=}CH_2$, $(CF_3)_2CF(CF_2)_5CH_2CH(OCOCH_3)OCOCR^6{=}CH_2$, $(CF_3)_2CF(CF_2)_5CH_2CH(OH)CH_2OCOCR^6{=}CH_2$, $(CF_3)_2CF(CF_2)_7CH_2CH(OH)CH_2OCOCR^6{=}CH_2$, $F(CF_2)_9CH_2CH_2OCOCR^6{=}CH_2$, $F(CF_2)_9CONHCH_2CH_2OCOCR^6{=}CH_2$, $F(CF_2)_9SO_2N(CH_3)CH_2CH_2OCH_2CH(CH_2Cl)OCOCR^6{=}CH_2$

As the vinylidene halide in the polymer (A), vinylidene chloride or vinylidene fluoride is preferred. Vinylidene chloride is particularly preferable, since it interacts with the polymer units represented by the formula 1 to improve the film forming property.

The long chain alkyl (meth)acrylate in the polymer (A) is an alkyl (meth)acrylate having an alkyl group moiety of at least 12 carbon atoms. The alkyl group moiety in the long chain alkyl (meth)acrylate may have a straight chain structure or a branched chain structure, preferably a straight chain structure. As the long chain alkyl(meth)acrylate, an alkyl (meth)acrylate containing an alkyl group moiety having from 12 to 22 carbon atoms is particularly preferred from the view point of the film forming property, and the hand and feeling when a film is formed. The long chain alkyl (meth) acrylate may preferably be dodecyl (meth) acrylate, hexadecyl (meth)acrylate, octadecyl (meth) acrylate, dococyl (meth)acrylate, etc.

Q in the polymer units represented in the formula 1 is —O— or —$NR^5$— (wherein $R^5$ is a hydrogen atom or an alkyl group). n methyl group, an ethyl group or a n-propyl group is preferred, when $R^5$ is an alkyl group. The polymer units represented by the formula 1 is polymer units of a (meth)acrylate having a particular cationic group, wherein each of $R^1$, $R^2$ and $R^3$ which are independent of one another is a hydrogen atom or an alkyl group. $R^1$ and $R^2$ may together form a bivalent organic group. This polymer units may preferably form a quaternary ammonium moiety as a particular cationic group. That is, it is preferred that each of $R^1$, $R^2$ and $R^3$ is independently an alkyl group, or $R^1$ and $R^2$ together form a bivalent organic group, and $R^3$ is an alkyl group. This alkyl group is preferably a methyl group or an ethyl group.

When $R^1$ and $R^2$ form together a bivalent organic group, the bivalent organic group is preferably a polymethylene group having at least two carbon atoms, a group wherein at least one hydrogen atom of said polymethylene group is substituted or a group wherein an ethernic oxygen atom is inserted between a carbon-carbon bond of said polymethylene group. Said substitution group of said polymethylene group is preferably a methyl group, an ethyl group, a n-propyl group, etc. Specific examples of $R^1$, $R^2$ and $R^3$ are shown in specific examples described later.

$R^4$ is a hydrogen atom or a hydroxyl group. n is an integer of from 1 to 4 and is preferably 1 or 2. $X^-$ is a counter ion and is preferably a chloride ion, a bromide ion, an iodide ion, a hydrogensulfate ion ($HSO_4$—) or an acetate ion.

The polymer units represented by the formula 1 in the polymer (A) may be composed of one type, or two or more types. In the case of two or more types, they may be preferably composed of alkyl group moieties or counter ions wherein they are different one another. The polymer units represented by the formula 1 impart high water repellency and oil resistance to papers even under dry condition at low temperature and in a short time after treated with the agent and also to improve stability of the treating agent.

The following units are mentioned as specific examples of the polymer units represented as the formula 1. In the followings, R, Q and X represent the same meanings as defined in the formula 1.

—$[CH_2—C(R)[COO(CH_2)_2N^+(CH_3)_3.X^-]]$—,

—$[CH_2—C(R)[COO(CH_2)_3N^+(CH_3)_3.X^-]]$—,

—$[CH_2—C(R)[COO(CH_2)_2N^+(CH_2CH_3)_3.X^-]]$—,

—$[CH_2—C(R)[COO(CH_2)_3N^+(CH_2CH_3)_3.X^-]]$—,

—$[CH_2—C(R)[COOCH_2CH(OH)CH_2N^+(CH_3)_3.X-]]$—,

—$[CH_2—C(R)[COOCH_2CH(OH)CH_2N^+(CH_2CH_3)_3.X^-]]$—,

—$[CH_2—C(R)[CONH(CH_2)_2N^+(CH_3)_3.X^-]]$—,

—$[CH_2—C(R)[CONH(CH_2)_3N^+(CH_3)_3.X^-]]$—,

—$[CH_2—C(R)[CONH(CH_2)_2N^+(CH_2CH_3)_3.X^-]]$—,

—$[CH_2—C(R)[CONH(CH_2)_3N^+(CH_2CH_3)_3.X^-]]$—, $—[CH_2—C(R)[COO(CH_2)_2N^+H(CH_3)_2.X^-]]—$,
$—[CH_2—C(R)[COO(CH_2)_3N^+H(CH_3)_2.X^-]]—$,
$—[CH_2—C(R)[COO(CH_2)_2N^+H\ (CH_2CH_3)_2.X^-]]—$,
$—[CH_2—C(R)[CONH(CH_2)_2N^+H(CH_3)_2.X^-]]—$,
$—[CH_2—C(R)[CONH(CH_2)_3N^+H(CH_3)_2.X^-]]—$,
$—[CH_2—C(R)[CONH(CH_2)_2N^+H\ (CH_2CH_3)_2.X^-]]—$,
$—[CH_2—C(R)[CONH(CH_2)_3N^+H(CH_2CH_3)_2.X^-]]—$.

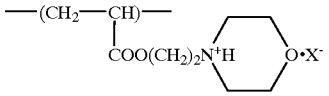

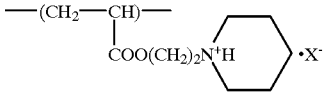

The polymer units of the formula 1 are preferably polymer units having the following formula 1a, wherein the R and $X^-$ have the meanings as defined in the formula 1.

$$—[CH_2—C(R)[COO—CH_2—CH(OH)—CH_2N^+(CH_3)_3.X^-]]— \quad \text{Formula 1a}$$

The polymer (A) of the present invention may further contain other polymer units (hereinafter referred as polymer units of other polymerizable monomer) in addition to the polymer units of a (meth)acrylate having a $R^f$ group, the polymer units of a vinylidene halide, the polymer units of a long chain (meth)acrylate and the polymer units of the formula 1.

The following monomers may be mentioned as specific examples of other polymerizable monomers:

Ethylene, vinyl acetate, vinyl chloride, vinyl fluoride, a halogenated vinyl styrene, α-methyl styrene, p-methyl styrene, (meth)acrylic acid, a polyoxyalkylene mono(meth) acrylate, (meth)acrylamide, diacetone, methylol(meth) acrylamide, N-methylol(meth)acrylamide, an alkylvinyl ether, a halogenated alkylvinyl ethers, an alkyl vinyl ketones, butadiene, isoprene, chloroprene, glycidyl (meth) acrylate, 2-hydroxyethyl (meth)acrylate, aziridinyl (meth) acrylate, benzyl (meth)acrylate, isocyanate ethyl (meth) acrylate, cyclohexyl (meth)acrylate, a short chain alkyl (meth)acrylate, maleic anhydride, a (meth)acrylate having a polydimethyl siloxane moiety, N-vinyl carbazole, etc.

In the above, a short chain alkyl(meth)acrylate may be an alkyl (meth)acrylate having an alkyl group of from 1 to 11 carbon atoms. Methyl (meth)acrylate, ethyl (meth)acrylate or ethylhexyl (meth)acrylate is preferred.

When the polymer (A) contains, as an essential component, the polymer units of a vinylidene halide, the polymer units of an alkyl (meth)acrylate and/or the polymer units of other polymerizable monomer mentioned above are preferably contained in the polymer (A). The polymer units of other polymerizable monomer may be one type, or two or more types. As the alkyl (meth)acrylate, a long chain alkyl (meth)acrylate is particularly preferred from the view point of the film forming property, and feeling and the hand when a film is formed. The polymer units of other polymerizable monomer may be one type, or two or more types. When the polymer (A) contains, as an essential component, the polymer units of a long chain alkyl (meth)acrylate, no polymer units of other polymerizable monomer are preferably contained in the polymer (A).

The amount of the polymer units of an alkyl (meth) acrylate having a $R^f$ group in the polymer (A) is preferably from 34.5 to 80 wt %. The total amount of the polymer units of a vinylidene halide and the polymer units of a long chain alkyl (meth)acrylate is preferably from 19.5 to 65 wt %. The amount of the polymer units of formula 1 is preferably 0.5 to 15 wt %. When the polymer units of other polymerizable monomer are contained, their amount in the polymer (A) is preferably 0.1 to 30 wt %. The amount of the polymer (A) in the composition is preferably from 1 to 30 wt %.

As the surfactant (B), it is preferred to employ a nonionic surfactant and/or a cationic surfactant as an essential component. In order to improve various properties of the treating agent, it is particularly preferred to incorporate at least one member selected from the surfactant ($b^1$), the surfactant ($b^2$), the surfactant ($b^3$) and the surfactant ($b^4$), as an essential component, and another surfactant (hereinafter, referred to as other surfactant) other than the above surfactant ($b^1$) to the surfactant ($b^4$) mentioned above, as an optional component.

The surfactant ($b^1$): a nonionic surfactant selected from the group consisting of a polyoxyalkylene monoalkyl ether, a polyoxyalkylene monoalkenyl ether and a polyoxyalkylene mono(substituted aryl) ether.

The surfactant ($b^2$): a nonionic surfactant comprising a compound having at least one carbon-carbon triple bond and at least one hydroxyl group in its molecule.

The surfactant ($b^3$): a nonionic surfactant comprising a compound having a structure wherein a polyoxyethylene moiety and a moiety of at least two oxyalkylene groups having at least 3 carbon atoms are connected each other and each terminal of its molecule is a hydroxyl group.

The surfactant ($b^4$) is a cationic surfactant having the formula 2:

$$[(R^{10})(R^{11})(R^{12})(R^{13})N^+].[X^{10}]^- \quad \text{Formula 2}$$

wherein each of $R^{10}$, $R^{11}$, $R^{12}$ and $R^{13}$ which are independent of one another is a hydrogen atom, an alkyl group having from 1 to 22 carbon atoms, an alkenyl group having from 2 to 22 carbon atoms or a polyoxyalkylene group having a hydroxyl group at the terminal of its molecule, provided that $R^{10}$, $R^{11}$, $R^{12}$ and $R^{13}$ are not hydrogen atoms at the same time. $[X^{10}]^-$ is a counter ion.

The surfactants ($b^1$)–($b^4$) will be explained in detail in the following.

The surfactant ($b^1$)

The surfactant ($b^1$) is a nonionic surfactant selected from the group consisting of a polyoxyalkylene monoalkyl ether, a polyoxyalkylene monoalkenyl ether and a polyoxyalkylene mono (substituted aryl) ether.

The alkyl group in the polyoxyalkylene monoalkyl ether is preferably an alkyl group having from 4 to 26 carbon atoms. The alkenyl group in the polyoxyalkylene monoalkenyl ether is preferably an alkenyl group having from 4 to 26 carbon atoms. Each of the alkyl group and the alkenyl group may have a straight chain structure or a branched chain structure and may be a bivalent group in the case of a branched chain structure. As specific examples of the alkyl group and the alkenyl group, an octyl group, a dodecyl group, a tetradecyl group, a hexadecyl group, an octadecyl group, a docosyl group, an oleyl group (a 9-octadecenyl group), etc. may be mentioned.

The substituted aryl group in the polyoxyalkylene mono (substituted aryl) ether is preferably a substituted phenyl group, for example, a phenyl group substituted with an alkyl group, an alkenyl group, a hydroxyphenyl group, a methyl group, a hydroxyl group or a styryl group. A phenyl group substituted with an alkyl group is particularly preferred. A phenyl group substituted with an alkyl group having at least 6 carbon atoms or an alkenyl group having at least 6 carbon atoms is most particularly preferred.

The polyoxyalkylene moiety of the surfactant ($b^1$) is preferably composed of at least one polyoxyalkylene group, and the chain structure is preferably of a block type when it is composed of at least two polyoxyalkylene groups. The polyoxyalkylene moiety is preferably a moiety wherein at least two polyethylene groups and/or oxypropylene groups are connected to each other.

When the surfactant ($b^1$) is a polyoxyalkylene monoalkyl ether or a polyoxyalkylene monoalkenyl ether, it is preferably a nonionic surfactant comprising a compound of the following formula 3. In the formula 3, $R^{20}$ is an alkyl group having at least 8 carbon atoms or an alkenyl group having at least 8 carbon atoms. s is an integer of from 5 to 50 and g is an integer of 0 to 20. The chain structure in oxyethylene groups and oxypropylene groups in the formula is of a block type.

$$R^{20}O—[CH_2CH(CH_3)O]_g—(CH_2CH_2O)_sH \quad \text{Formula 3}$$

$R^{20}$ in the formula 3 may be a straight chain structure or a branched chain structure. s is preferably an integer of from 5 to 30, particularly preferable an integer of from 10 to 30. g is preferably an integer of from 0 to 10. When s is 3 or less, or 21 or more, the surfactant becomes water-insoluble so that an improvement in the penetration of the treating agent decreases since the surfactant can hardly be uniformly dissolved in an aqueous medium. When s is 51 or more, the water repellency of the treating agent tends to decrease as the hydrophilicity of the surfactant increases.

Specific examples of the nonionic surfactant of the formula 3 are mentioned below, although it is not limited to them. In the following, s and g have the same meanings as defined above. s is preferably an integer of from 10 to 30 and g is preferably an integer of from 0 to 10. The alkyl group and the alkenyl group may be of a straight chain structure or a branched chain structure. The chain structure of oxyethylene groups and oxypropylene groups in the formula is of a block type.

$C_{18}H_{37}O—[CH_2CH(CH_3)O]_g—(CH_2CH_2O)_sH$,
$C_{18}H_{35}O—[CH_2CH(CH_3)O]_g—(CH_2CH_2O)_sH$,
$C_{16}H_{33}O—[CH_2CH(CH_3)O]_g—(CH_2CH_2O)_sH$,
$C_{12}H_{25}O—[CH_2CH(CH_3)O]_g—(CH_2CH_2O)_sH$,
$(C_8H_{17})(C_6H_{13})CHO—[CH_2CH(CH_3)O]_g—(CH_2CH_2O)_s—H$,
$C_{10}H_{21}O—[CH_2CH(CH_3)O]_g—(CH_2CH_2O)_sH$.

When the surfactant ($b^1$) is a polyoxyalkylene mono (substituted aryl)ether, its specific examples are as follows: polyoxyethylene mono (nonylphenyl) ether, polyoxyethylene mono (octylphenyl) ether, polyoxyethylene mono (oleylphenyl) ether.

The surfactant ($b^2$)

The surfactant ($b^2$) is a nonionic surfactant comprising a compound having at least one carbon-carbon triple bond and at least one hydroxyl group in its molecule.

The surfactant ($b^2$) is preferably a nonionic surfactant comprising a compound having one carbon-carbon triple bond and one or two hydroxyl group(s) in its molecule. The surfactant may contain at least one oxyalkylene moiety. The nonionic surfactant may contain at least one polyoxyalkylene moiety. The polyoxyalkylene moiety may be polyoxyethylene, polyoxypropylene, a randomly bonded moiety of oxyethylene and oxypropylene or a block chain moiety of polyoxyethylene and polyoxypropylene.

The following compounds are mentioned as preferred specific examples of the surfactant ($b^2$).

$$HO—CR^{30}R^{31}—C≡C—CR^{32}R^{33}—OH \quad \text{Formula 4}$$

$$HO—(A^1O)_m—CR^{30}R^{31}—C≡C—CR^{32}R^{33}—(OA^2)_q—OH \quad \text{Formula 5}$$

$$HO—CR^{34}R^{35}—C≡C—H \quad \text{Formula 6}$$

$$HO—(A^3O)_k—CR^{34}R^{35}—C≡C—H \quad \text{Formula 7}$$

In the above formulas, each of $R^{30}$, $R^{31}$, $R^{32}$, $R^{33}$, $R^{34}$ and $R^{35}$ which are independent of one another is a hydrogen atom or an alkyl group. The alkyl group is preferably a straight chain type or a branched chain type alkyl group having from 1 to 12 carbon atoms. A methyl group, an ethyl group, a propyl group, a butyl group, an isobutyl group, etc. may be mentioned.

Each of $A^1$, $A^2$ and $A^3$ which are independent of one another is an alkylene group. Each of m and q is an integer of at least 0 and (m+q) is an integer of at least 1. K is an integer of at least 1. When each of m, q and k is at least 2, each of $A^1$, $A^2$ and $A^3$ may be one type of an alkylene group, or two or more types of alkylene groups.

Further, the surfactant ($b^2$) is preferably a nonionic surfactant made of a compound of the formulas 4 or 5, or a compound of the following formula 8 wherein each of x and y is an integer of at least 0. The compound of the formula 8 may be one type, or two or more types.

Formula 8

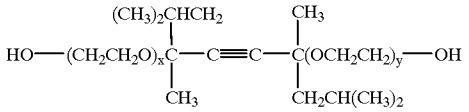

The compound of the formula 8 is preferably a compound wherein an average of the sums of x and y is 10 or a compound wherein x is 0 and y is 0, or a compound wherein an average of the sums of x and y is 1.3.

The surfactant ($b^3$)

The surfactant ($b^3$) is a nonionic surfactant comprising a compound having a structure wherein a polyoxyethylene moiety and a moiety of at least two oxyalkylene groups having at least 3 carbon atoms are connected each other and each terminal of its molecule is a hydroxyl group. The moiety of at least two oxyalkylene groups having at least 3 carbon atoms is preferably a polyoxytetramethylene and/or a polyoxypropylene.

The surfactant ($b^3$) is preferably a compound of the following formula 9 or the formula 10, wherein h is an integer of from 2 to 200, r is an integer of from 2 to 100 and t is an integer of from 2 to 200. Further, in the following formulas, each of a moiety of polyoxyethylene, a moiety of polyoxypropylene and a moiety of polyoxytetramethylene is connected in block-like. The structure of moiety of $—(C_3H_6O)—$ may be $—[CH_2CH(CH_3)O]—$, $—[CH(CH_3)CH_2O]—$ or a combination of both. The structure of the combination of both is preferred.

$$HO—(CH_2CH_2O)_h—(C_3H_6O)_r—(CH_2CH_2O)_tH \quad \text{Formula 9}$$

$$HO—(CH_2CH_2O)_h—(CH_2CH_2CH_2CH_2O)_r—(CH_2CH_2O_tH \quad \text{Formula 10}$$

$HO—(CH_2CH_2O)_{15}—(C_3H_6O)_{35}—(CH_2CH_2O)_{15}H$,
$HO—(CH_2CH_2O)_8—(C_3H_6O)_{35}—(CH_2CH_2O)_8H$,
$HO—(C_2CH_2O)_{45}—(C_3H_6O)_{17}—(CH_2CH_2O)_{451}H$,
$HO—(CH_2CH_2O)_{34}—(CH_2CH_2CH_2CH_2O)_{28}—(CH_2CH_2O)_{34}H$.

The surfactant ($b^4$)

The surfactant ($b^4$) is a cationic surfactant having said formula 2. When each of $R^{10}$–$R^{13}$ is an alkyl group in the formula 2, at least one of them is preferably a long chain alkyl group having from 6 to 22 carbon atoms. When the alkyl group having 5 or less carbon atoms is contained, it is preferably a methyl group or an ethyl group. When each of $R^{10}$ and $R^{13}$ is an alkenyl group, it is preferably an alkenyl group having from 6 to 22 carbon atoms. When each of $R^{10}$ and $R^{13}$ is a polyoxyalkylene group having a hydroxyl group at its terminal, it is preferably a polyoxyethylene group having a hydroxyl group at its terminal. At least one of $R^{10}$–$R^{13}$ is preferably a long chain alkyl group having from 6 to 22 carbon atoms.

$[X^{10}]^-$ is preferably a chloride ion, an ethylsulfate ion, a sulfate ion or an acetate ion.

The following compounds may be mentioned as specific examples of the cationic surfactant of the formula 2. A mono(a long chain alkyl)amine hydrochloride, a mono(a long chain alkyl)dimethylamine hydrochloride, a mono(a long chain alkyl)dimethylamine acetate, a mono(a long chain alkenyl)dimethylamine hydrochloride, a mono(a long chain alkyl) dimethylamine.ethylsulfate, a mono(a long chain alkyl)trimethyl ammonium chloride, a di(a long chain alkyl)monomethylamine hydrochloride, a di(a long chain alkyl)dimethyl ammonium chloride, a mono(a long chain alkyl)monomethyl(polyoxyethylene) ammonium chloride, a di(a long chain alkyl)monomethyl(polyoxyethylene) ammonium chloride, etc.

The following compounds are preferred as the cationic surfactant of the formula 2. A monooctadecyl trimethyl ammonium chloride, a monooctadecyl dimethyl monoethyl ammonium ethylsulfate, a mono(a long chain alkyl) monomethyl(polyethylene glycol) ammonium chloride, a di(beef tallow- alkyl)dimethyl ammonium chloride, a dimethyl monococonut amine acetate, etc.

Other surfactant is preferably a nonionic surfactant (hereinafter referred to as other nonionic surfactant) other than the surfactants ($b^1$) to ($b^4$) or an amphoteric surfactant. Other nonionic surfactant is preferably a condensation product of polyoxyethylene mono(alkylphenyl)ether, a polyol ester of a fatty acid, a polyoxyethylene fatty acid amide or a nonionic surfactant having an amine oxide moiety in its molecule.

Among other surfactants, the condensation product of polyoxyethylene mono(alkylphenyl)ether is preferably the above-mentioned formaldehyde condensation product of a polyoxyethylene mono (alkylphenyl) ether.

The following compounds are preferred as the polyol ester of a fatty acid. A 1:1 ( molar ratio) ester of octadecanoic acid and polyethylene glycol, a 1:4 ( molar ratio) ester of a sorbitol-polyethylene glycol ether and an oleic acid, a 1:1 ( molar ratio) ester of a polyethylene glycol-sorbitan ether and an octadecanoic acid, a 1:1 ( molar ratio) ester of a polyethylene glycol-sorbitan ether and an oleic acid, a 1:1 ( molar ratio) ester of a dodecanoic acid and sorbitan, a 1 or 2:1 ( molar ratio) ester of an oleic acid and deca glycerin, a 1 or 2:1 ( molar ratio) ester of an octadecanoic acid and deca glycerin.

The polyoxyethylene fatty acid amide is preferably an oxyethylene addition product of fatty acid amide or a nonionic surfactant made of anhydrous-condensation product of a fatty acid amide and a polyethylene glycol wherein an oxyethylene is added at a hydrogen atom of —$NH_2$ in the fatty acid amide, or a nonionic surfactant made of an anhydrous compound of a polyalkylene glycol. The polyoxyethylene fatty acid amide is particularly preferably an oxyethylene addition product of a dodecanoic acid amide, an oxyethylene addition product of an oleic acid amide, or an oxyethylene addition product of an octadecanoic acid amide.

The nonionic surfactant having an amine oxide moiety in its molecule is preferably a compound of the following formula 11, wherein each of $R^{41}$, $R^{42}$ and $R^{43}$ which are independent of one another is a monovalent hydrocarbon group. In the present specification, the surfactant having an amine oxide moiety in its molecule is defined as a nonionic surfactant, although it is sometimes classified as a cationic surfactant.

The nonionic surfactant having an amine oxide moiety (N→O) in its molecule is particularly preferably a nonionic surfactant of the following formula 12 due to an improvement in a dispersion property of the polymer (A).

In the formula 12, $R^{44}$ may be an alkyl group having from 6 to 22 carbon atoms, an alkenyl group having from 6 to 22 carbon atoms, a phenyl group bonded with an alkyl group (from 6 to 22 carbon atoms) or a phenyl group bonded with an alkenyl group (from 6 to 22 carbon atoms). $R^{44}$ is preferably an alkyl group having from 8 to 22 carbon atoms or an alkenyl group having from 8 to 22 carbon atoms.

$$(R^{41})(R^{42})(R^{43})N(\rightarrow O) \qquad \text{Formula 11}$$

$$(R^{44})(CH_3)_2N(\rightarrow O) \qquad \text{Formula 12}$$

The following compounds are mentioned as the nonionic surfactant having an amine oxide moiety in its molecule.

$[H(CH_2)_{12}](CH_3)_2N(\rightarrow O)$, $[H(CH_2)_{14}](CH_3)_2N(\rightarrow O)$, $[H(CH_2)_{16}](CH_3)_2N(\rightarrow O)$, $[H(CH_2)_{18}](CH_3)_2N(\rightarrow O)$.

The following compounds are mentioned as the amphoteric surfactant. dodecyl betaine, octadecyl betaine, dodecyl (dimethylamino acetic acid)betaine, a fatty acid amide propyl dimethylamino acetic acid betaine, dodecyl (carboxymethyl)(hydroxyethyl)imidazolinium betaine, etc.

As the surfactant (B), one type, or two or more types of surfactants may be used. When surfactants having different ion types are used together, a combination of a nonionic surfactant and a cationic surfactant or a combination of a nonionic surfactant and an amphoteric surfactant is preferred. The amount of the surfactant (B) is preferably from 0.1 wt % to 10 wt % based on the polymer (A). This amount may be reduced when the polymer (A) contains polymer units having a self emulsification property.

The medium (C) is preferably solely of water or water and a water-soluble organic solvent. In other words, the medium (C) is preferably an aqueous medium containing water and may contain an organic solvent in the aqueous medium, if necessary. The organic solvent is preferably a water-soluble organic solvent. The organic solvent including esters, ketones, ethers, etc. is preferred. The ratio of the amount of water and the organic solvent is not limited particularly. The amount of the medium (C) is preferably about from 0.1 to 40 wt % based on the polymer (A).

The following compounds are mentioned as specific examples of the organic solvent: acetone, ethylene glycol monoethyl ether monoacetate, ethylene glycol monoethyl ether, ethylene glycol monomethyl ether, ethylene glycol monobuthyl ether, propylene glycol monomethyl ether, propylene glycol monomethyl ether monoacetate, dipropylene glycol monomethyl ether, tripropylene glycol monomethyl ether, propylene glycol dibutyl ether, 3-ethoxydipropionic acid ethyl, 3-metoxy-3-methyl-butanol, 2-t-butoxy ethanol, isopropyl alcohol, n-butyl alcohol, ethanol, ethylene glycol, propylene glycol, dipropylene glycol, tripropylene glycol, etc.

As preferred organic solvents, the following solvents are mentioned: ethylene glycol monoethyl ether monoacetate, ethylene glycol monoethyl ether, ethylene glycol monomethyl ether, ethylene glycol monobuthyl ether, propylene glycol monomethyl ether, propylene glycol monomethyl ether monoacetate, dipropylene glycol monomethyl ether, tripropylene glycol monomethyl ether, propylene glycol dibutyl ether, etc.

The method for producing the polymer (A) of the present invention is not particularly limited. However, it is preferred to polymerize a (meth)acrylate having a $R^f$ group, vinylidene chloride, a polymerizable monomer of the following formula 1b (preferably, a polymerizable monomer of the following formula 1c) and, if necessary, other polymerizable monomer in the presence of the surfactant (B) in a aqueous medium by a known method such as an emulsion polymerization or a suspension polymerization. The symbols in the following formulas 1b and 1c are the same as defined in the formula 1.

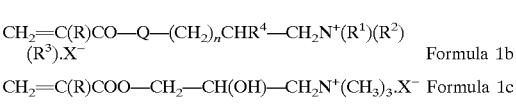

$$CH_2{=}C(R)CO{-}Q{-}(CH_2)_nCHR^4{-}CH_2N^+(R^1)(R^2)(R^3).X^- \quad \text{Formula 1b}$$

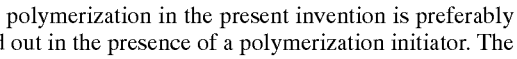

$$CH_2{=}C(R)COO{-}CH_2{-}CH(OH){-}CH_2N^+(CH_3)_3.X^- \quad \text{Formula 1c}$$

The polymerization in the present invention is preferably carried out in the presence of a polymerization initiator. The polymerization initiator is preferably a water-soluble compound or an oil soluble compound. The polymerization initiator such as an azo compound or its salt, a peroxide, or a redox compound, etc. may be used depending on a temperature of the polymerization. The polymerization initiator is preferably made of a water-soluble compound, and in particular, a salt of an azo compound is preferred.

The temperature of the polymerization is preferably from 20 to 150° C., although it is not particularly limited. A chain transfer agent may be present in the reaction of the polymerization in order to control the molecular weight of the polymer obtained. The chain transfer agent is preferably an aromatic compound or a mercaptan compound. The mercaptan compound, in particular an alkyl mercaptan, is particularly preferred. The following compounds are preferably mentioned as specific examples of the chain transfer agent: N-octyl mercaptan, n-dodecyl mercaptan, t-dodecyl mercaptan, octadethyl mercaptan, a α-methylstyrene dimmer, [$CH_2{=}CPhCH_2C(CH_3)_2Ph$ (Ph is a phenyl group)].

Further, a mixture composed of the polymerizable monomer, the surfactant and the aqueous medium can be preliminarily dispersed using eg. a homo mixer or a high pressure emulsifier before the initiation of the polymerization. The preliminarily dispersion before the polymerization increases the yield of the polymer finally obtained and improves the properties of the treating agent obtained. The surfactant may be added before or after the emulsion polymerization, or both before and after.

The composition of the present invention is preferably a water dispersed type composition for treating papers wherein the polymer (A) is dispersed in an aqueous medium in the present of the surfactant (B). The composition can be prepared by dispersing the polymer (A) into a desired aqueous solvent. Usually, the water-dispersed type water and oil repellent composition can be in situ prepared by using a desired medium (C) as a polymerization medium.

The treatment of papers with the composition of the present invention is conducted preferably by a method such as a dipping method, a coating method etc. The application of the composition to paper can be made by a post-treating method or a pre-treating method. The outer-adding method is preferred since its treatment is simple. The drying condition after the treatment with the composition for papers in the present invention is not particularly limited. However, since the composition of the present invention shows adequate performance even under a drying condition at low temperature and in a short time, the drying temperature is preferable from 60 to 130° C. and the drying time is preferably from one second to one minute, particularly from 1 to 30 seconds. The amount of the composition applied to papers is preferably from 0.1 to 3.0 wt %. The treated papers can be used preferably as a container, a package, etc. for foods, etc. as it is or after processed into other forms.

Now, the present invention will be described in further detail with reference to Examples. However, it should be understood that the present invention is by no means restricted to such specific Examples.

The evaluation methods in Examples are as follows.

Evaluation Method of Oil Resistance

The oil resistance was measured by the kit test method of TAPPI RC-388. A blended oil of caster oil, toluene and n-heptane in the ratio (weight) shown in Table 1 was placed on the surface of a treated paper. As the evaluation result, the oil resistance is represented by the highest number of the one among the mixed oils which showed no penetration into the paper. The larger the numerical value, the superior the oil resistance.

TABLE 1

| Oil resistance | Castor oil | Toluene | n-Heptane |
|---|---|---|---|
| 1 | 100 | 0 | 0 |
| 2 | 90 | 5 | 5 |
| 3 | 80 | 10 | 10 |
| 4 | 70 | 15 | 15 |
| 5 | 60 | 20 | 20 |
| 6 | 50 | 25 | 25 |
| 7 | 40 | 30 | 30 |
| 8 | 30 | 35 | 35 |
| 9 | 20 | 40 | 40 |
| 10 | 10 | 45 | 45 |
| 11 | 0 | 50 | 50 |
| 12 | 0 | 45 | 55 |

Evaluation Method of Sizing Property

The Stöckigt sizing degree was measured in accordance with the method prescribed in JIS P8122. The sizing degree is represented by the time (unit: second) at which one red point occurs by dropping 1 wt % of ferric chloride on the surface of the treated paper floating in an aqueous solution of 2 wt % of ammonium thiocyanate. The larger the value, the superior the sizing property.

Evaluation Method of Water Repellency

The water repellency was measured in accordance with the method prescribed in JIS P8137 and evaluated by the standard shown in Table 2.

TABLE 2

| Results | Repellency |
|---|---|
| The result indicating continuous trace with uniform width | $R_0$ |
| The results indicating continuous trace with width slightly narrower than water drop | $R_2$ |
| The result indicating continuous trace but broken at some places with width clearly narrower than the water drop | $R_4$ |
| The result indicating that half the trace is wet | $R_6$ |

TABLE 2-continued

| Results | Repellency |
|---|---|
| The result indicating that ¼ of the trace is wet by long elongated water drop | $R_7$ |
| The result indicating that more than ¼ of the trace is spattered with small spherical water drops | $R_8$ |
| The result indicating that small spherical water drops are spattered at some places | $R_9$ |
| The result indicating the complete rolling down | $R_{10}$ |

Evaluation Method of Mechanical Stability of Emulsion

The emulsion was obtained by stirring the treatment liquid at 5,000 rpm for 30 minutes using a homomixer while the treatment liquid diluted with water to its solid content concentration of 0.5 wt % was maintained at 40° C. The emulsion after stirred was filtered through a well-washed metal mesh of 200 mesh. The floatation residue of the emulsion on the metal mesh was filtered and was dried. Its weight (unit: mg) was measured. The smaller the weight, the superior the mechanical stability.

The meanings of the following abbreviations are as follows.

VdCl: vinylidene chloride,

HPTMA: 3-methacryloyloxy-2-hydroxypropyltrimethylammonium chloride [$CH_2{=}C(CH_3)CO{-}O{-}CH_2CH(OH)CH_2N^+(CH_3)_3.Cl^-$], ETMMA: 2-methacryloyloxy ethyltrimethyl ammonium chloride [$CH_2{=}C(CH_3)CO{-}O{-}(CH_2)_2N^+(CH_3)_3.Cl^-$], DMAEMAA: N-methacryloyl-2-aminoethyl diammonium acetate [$CH_2{=}C(CH_3)CO{-}NH{-}(CH_2)_2N^+(CH_3)_2H.(CH_3COO^-)$], DMAEMAM: 2-methacryloyloxy ethyldimethylammonium chloride [$CH_2{=}C(CH_3)CO{-}O{-}(CH_2)_2N^+(CH_3)_2H.Cl^-$], DMAEMAC: N-methacryloyl-2-aminoethyldiammonium chloride [$CH_2{=}C(CH_3)CO{-}NH{-}(CH_2)_2N^+(CH_3)_2H.Cl^-$], AM: acrylamide, EA: ethyl acrylate, N-MAM: N-methylolacrylamide, StA: octadecyl acrylate

EXAMPLE 1

Into a 1 l polymerization reaction vessel equipped with a stirrer, 150 g of a 2-perfluoroalkylethyl acrylate (a mixture of the compounds, $(F(CF_2)_jCH_2CH_2OCOCH{=}CH_2$, wherein j is 6, 8, 10, 12, 14 and 16, and an average of j is 9; hereinafter, referred to as FA), 95.0 g of VdCl, 5.0 g of HPTMA, 12.5 g of polyoxyethylene monooleyl ether as the surfactant, 375.0 g of ion exchanged water, 112.5 g of dipropylene glycol monomethyl ether and 1.25 g of 2,2'-azobis(isobutylamidine) dihydrochloride as the polymerization initiator, were charged.

After the atmosphere of the reaction vessel was substituted with nitrogen, the temperature was raised to 60° C. under stirring at 300 rpm. The polymerization reaction was conducted for 15 hours. By recovering from the reaction vessel after having cooled, the brown colored emulsion was obtained with a yield of 96%. The conversion in the copolymerization reaction by the gas chromatography (GC) was 99.6% on the FA base.

This emulsion was diluted with the ion-exchanged water to obtain a treating bath having a solid content concentration of 0.6 wt %. In this treating bath, non-sized paper(weight: 40 g/m$^2$)was dipped and treated by means of a sizing press at a rate such that the pick up was 50%. Then, it was dried for 10 seconds by means of drum dryer heated to 100° C. to obtain a treated paper. The evaluation results on oil resistance, sizing property and water repellency of the paper, and mechanical stability of the emulsion are shown in Table 3.

EXAMPLES 2 to 8 (EXAMPLES 6 to 8: COMPARATIVE EXAMPLES)

In the same manner as in Example 1, the emulsions having the copolymerization ratio shown in the following Table 3 were prepared and the treated papers were obtained by treating the papers with the emulsions. The oil resistance, sizing property and water repellency of the treated papers, and mechanical stability of the emulsion were evaluated. Their results are summarized in Table 3.

TABLE 3

| Example | Copolymerization ratio (wt %) | Oil resistance | Sizing property | Water repellency | Mechanical stability |
|---|---|---|---|---|---|
| 1 | FA/VdCl/HPTMA 60/38/2 | 12 | 10 | 8 | 1.2 |
| 2 | FA/VdCl/HPTMA 55/43.5/1.5 | 12 | 12 | 10 | 1.3 |
| 3 | FA/VdCl/ETMMA 55/43/2 | 12 | 10 | 10 | 1.1 |
| 4 | FA/VdCl/DMAEMAA 55/43/2 | 10 | 9 | 9 | 1.5 |
| 5 | FA/VdCl/DMAEMAM 55/43/2 | 11 | 10 | 8 | 2.1 |
| 6 | FA/VdCl/AM 40/55/5 | 3 | 3 | 4 | 8.6 |
| 7 | FA/VdCl/N-MAM 60/38/2 | 4 | 5 | 6 | 9.3 |
| 8 | FA/VdCl/EA/AM 60/30/5/5 | 4 | 5 | 6 | 10.3 |

EXAMPLE 9

Into a 1 l polymerization reaction vessel equipped with a stirrer, 137.5 g of FA, 107.5 g of StA, 5.0 g of HPTMA, 12.5 g of polyoxyethylene monooleyl ether, 375.0 g of ion exchanged water, 112.5 g of dipropylene glycol monomethyl ether and 1.25 g of 2,2'-azobis(isobutylamidine)2 hydrochloride, were charged. After the atmosphere of the reaction vessel was substituted with nitrogen, the temperature was raised to 60° C. under stirring at 300 rpm. The polymerization reaction was conducted for 15 hours. The milk-white colored emulsion was obtained with a yield of 94%. The conversion rate in the copolymerization reaction by GC was 99.6% on the FA base.

This emulsion was diluted with 1% aqueous solution of polyvinyl alcohol to the solid content concentration of 0.9 wt % and used as the treating bath. In this treating bath, bleached kraft paper (weight: 40 g/m$^2$) was dipped and treated by means of a sizing press at a rate such that the pick up was 50%. Then, it was dried for 10 seconds by means of drum dryer heated to 100° C. to obtain a treated paper. The evaluation results of the oil resistance, sizing property and water repellency of the paper, and mechanical stability of the emulsion are shown in Table 4.

EXAMPLES 10–16 (EXAMPLES 14 to 16: COMPARATIVE EXAMPLES)

In the same manner as in Example 9, the emulsions having the copolymerization ratio shown in Table 4 were prepared and the treated papers were obtained by treating the papers with the emulsions. The oil resistance, sizing property and water repellency, and mechanical stability of the emulsion of the treated papers were evaluated. The results are summarized in Table 4.

TABLE 4

| Example | Copolymerization ratio (wt %) | Oil resistance | Sizing property | Water repellency | Mechanical stability |
|---|---|---|---|---|---|
| 9 | FA/StA/HPTMA 55/43/2 | 13 | 10 | 9 | 1.1 |
| 10 | FA/StA/HPTMA 60/38.5/1.5 | 14 | 12 | 10 | 1.3 |
| 11 | FA/StA/ETMMA 55/43/2 | 12 | 9 | 9 | 1.1 |
| 12 | FA/StA/DMAEMAA 55/43/2 | 12 | 9 | 9 | 1.5 |
| 13 | FA/StA/DMAEMAC 55/43/2 | 11 | 10 | 8 | 2.1 |
| 14 | FA/StA/AM 45/50/5 | 4 | 3 | 2 | 8.6 |
| 15 | FA/StA/N-MAM 55/43/2 | 4 | 5 | 3 | 9.3 |
| 16 | FA/StA/EA/AM 60/30/5/5 | 5 | 5 | 3 | 10.3 |

The composition for treating papers of the present invention can impart superior water repellency and oil resistance to papers, even if treated papers are dried at low temperature and in short time in the paper treatment. Further, the composition for treating papers of the present invention maintains superior mechanical stability, even under high speed, in dipping, nipping, circulation of a treating liquid, etc., and is thus excellent in practical use.

What is claimed is:

1. A composition for treating paper comprising a polymer (A), a surfactant (B) and a medium (C), wherein said polymer (A) comprises polymer units of (1) (meth)acrylate having a polyfluoroalkyl group, (2) polymer units of a vinylidene halide and/or polymer units of a long chain alkyl(meth)acrylate, and (3) polymer units of the following formula 1:

$$—[CH_2—C(R)[CO—Q—(CH_2)_nCHR^4—CH_2N^+(R^1)(R^2)(R^3).X^-]]—, \quad \text{Formula 1}$$

wherein R is a hydrogen atom or a methyl group; Q is —O— or —$NR^5$—, wherein $R^5$ is a hydrogen atom or an alkyl group; each of $R^1$, $R^2$ and $R^3$ which are independent of one another is a hydrogen atom or an alkyl group; $R^1$ and $R^2$ may together form a bivalent organic group; $R^4$ is a hydrogen atom or a hydroxyl group; n is a number from 1 to 4 and $X^-$ is a counter ion.

2. The composition for treating paper according to claim 1, wherein the vinylidene halide in the polymer (A) is vinylidene chloride.

3. The composition for treating paper according to claim 1, wherein the long chain alkyl(meth)acrylate has an alkyl group having from 12 to 22 carbon atoms.

4. The composition for treating paper according to claim 1, wherein the polymer units having the formula 1 of the polymer (A) are polymer units of the following formula 1a:

$$—[CH_2—C(R)[COO—CH_2—CH(OH)—CH_2N^+(CH_3)_3.X^-]]— \quad \text{Formula 1a.}$$

5. The composition for treating paper according to claim 1, wherein the amount of the polymer units of a (meth) acrylate having a polyfluoroalkyl group in the polymer (A) is from 34.5 to 80 wt %.

6. The composition for treating paper according to claim 1, wherein the total amount of the polymer units of a vinylidene halide and the polymer units of a long chain alkyl(meth)acrylate in the polymer (A) is from 19.5 to 65 wt %.

7. The composition for treating paper according to claim 1, wherein, the amount of the polymer units of the formula 1 is from 0.5 to 15 wt %.

8. The composition for treating paper according to claim 1, wherein the surfactant (B) is at least one member selected from the group consisting of a surfactant ($b^1$), a surfactant ($b^2$), a surfactant ($b^3$), and a surfactant ($b^4$), wherein the surfactant ($b^1$) is a nonionic surfactant selected from the group of consisting of a polyoxyalkylene monoalkyl ether, an polyoxyalkylene monoalkenyl ether and a polyoxyalkylene mono(substituted aryl) ether; the surfactant ($b^2$) is a nonionic surfactant comprising a compound having one or more than one triple bond and a hydroxyl group in its molecule; the surfactant (b3) is a nonionic surfactant comprising a compound having a structure wherein a polyoxyethylene moiety and a moiety of at least two oxyalkylene groups having at least 3 carbon atoms are connected each other and each terminal of its molecule is a hydroxyl group; the surfactant ($b^4$) is a surfactant having the formula 2:

$$[(R^{10})(R^{11})(R^{12})(R^{13})N^+].[X^{10}]^- \quad \text{Formula 2}$$

wherein each of $R^{10}$, $R^{11}$, $R^{12}$ and $R^{13}$ which are independent of one another is a hydrogen atom, an alkyl group having from 1 to 22 carbon atoms, an alkenyl group having from 2 to 22 carbon atoms or a polyoxyalkylene group having a hydroxyl group at the terminal of its molecule, provided that $R^{10}$, $R^{11}$, $R^{12}$ and $R^{13}$ are not hydrogen atoms at the same time; $[X^{10}]^-$ is a counter ion.

9. The composition for treating paper according to claim 1, wherein the medium (c) is solely of water or water and a water-soluble organic solvent.

10. The composition for treating paper according to claim 2, wherein the long chain alkyl(meth)acrylate has an alkyl group having from 12 to 22 carbon atoms.

11. The composition for treating paper according to claim 2, wherein the polymer units having the formula 1 of the polymer (A) is polymer units of the following formula 1a:

$$—[CH_2—C(R)[COO—CH_2—CH(OH)—CH_2N^+(CH_3)_3.X^-]]— \quad \text{Formula 1a.}$$

12. The composition for treating paper according to claim 10, wherein the polymer units having the formula 1 of the polymer (A) is polymer units of the following formula 1a:

$$—[CH_2—C(R)[COO—CH_2—CH(OH)—CH_2N^+(CH_3)_3.X^-]]— \quad \text{Formula 1a.}$$

13. A paper treated with the composition for treating paper as defined in claim 1.

14. A paper treated with the composition for treating paper as defined in claim 1.

* * * * *